United States Patent [19]

Kobayashi et al.

[11] Patent Number: 4,795,088

[45] Date of Patent: Jan. 3, 1989

[54] AIR CONDITIONING SYSTEM

[75] Inventors: Toyohiro Kobayashi, Shizuoka; Nobuo Otsuka, Kamakura, both of Japan; Peter Thompson; Larry J. Stratton, both of Cypress, Calif.

[73] Assignee: Mitsubishi Denki Kabushiki Kaisha, Tokyo, Japan

[21] Appl. No.: 60,496

[22] Filed: Jun. 11, 1987

[51] Int. Cl.[4] ..... F24F 7/00; F25B 49/00

[52] U.S. Cl. ..... 236/49; 236/91 R; 165/22; 165/29; 62/298

[58] Field of Search ..... 236/49, 46 R, 1 B, 91 R, 236/91 C, 91 D, 91 F, 91 E, 91 G, DIG. 9; 165/22, 29; 62/298, 77

[56] References Cited

U.S. PATENT DOCUMENTS 4,406,397 9/1983 Kamata et al. ..... 165/22 X
4,549,601 10/1985 Wellman et al. ..... 165/16 X
4,627,483 12/1986 Harshbarger, III et al. .... 165/29 X

FOREIGN PATENT DOCUMENTS 1164071 3/1984 Canada ..... 236/46 R

*Primary Examiner*—Harry B. Tanner
*Attorney, Agent, or Firm*—Alan B. Samlan

[57] ABSTRACT

A duct type air conditioning system with a variable capacity blower in which the maximum blower capacity is established at initialization of the system at the optimum blower capacity. The optimum capacity is established by varying the capacity of the blower and measuring the air flow volume and air flow noise. The optimum capacity is inputed into the control system through a central thermostat which has a liquid crystal display associated therewith. The system installer interfaces with the control system by a dialog which occurs through the liquid crystal display. The optimum capacity of the blower is stored in a memory device, and the control system variably controls the capacity of the blower so as not to exceed the optimum capacity.

33 Claims, 7 Drawing Sheets

FIGURE 3
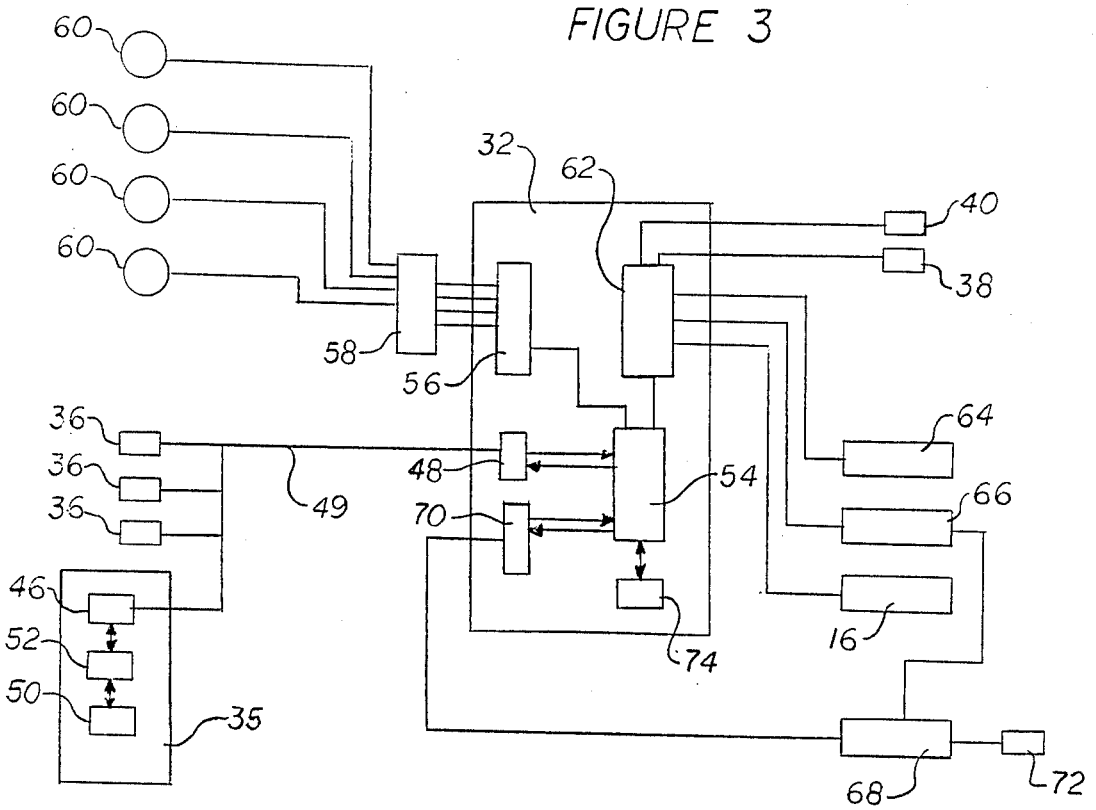
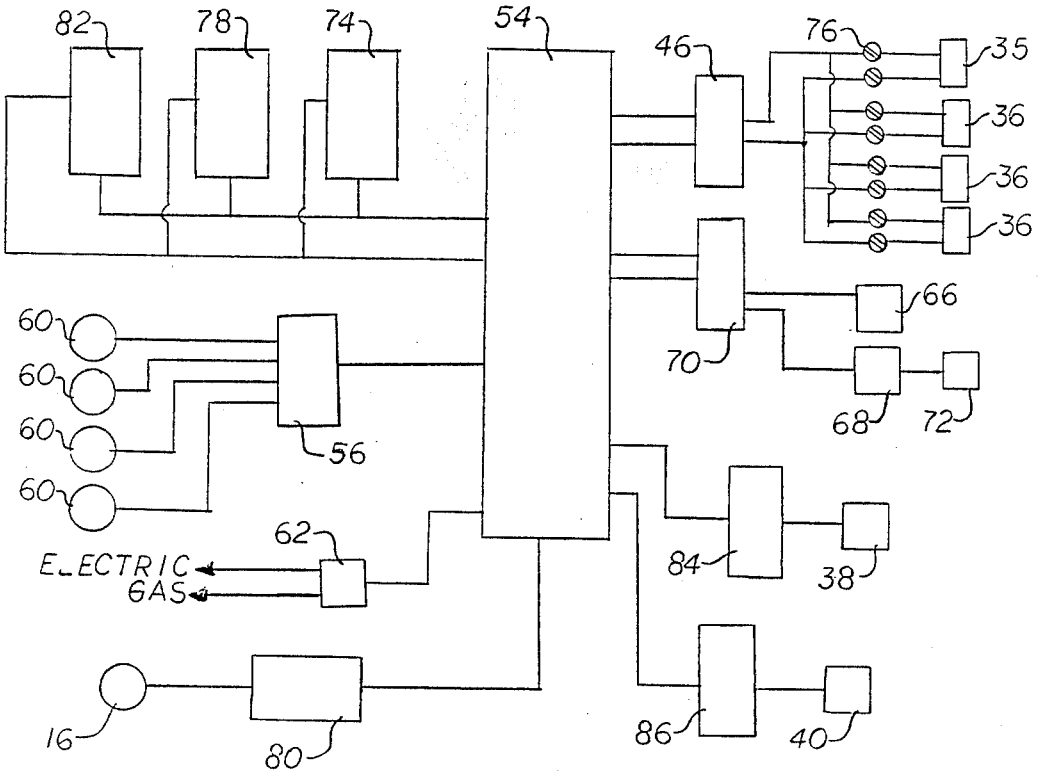
FIGURE 4

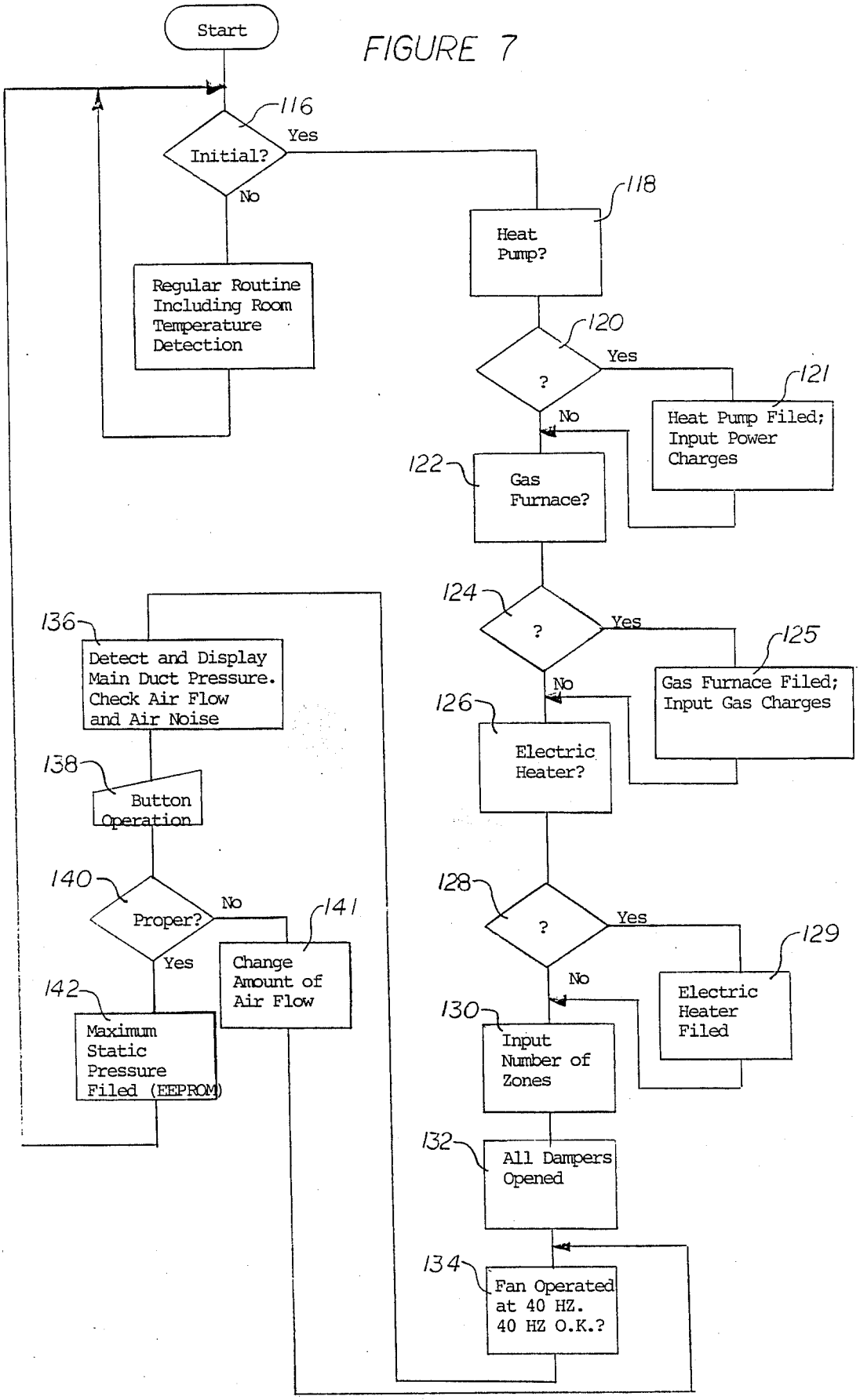
FIGURE 7
Start
116
Initial?
Yes
No
Regular Routine Including Room Temperature Detection
118
Heat Pump?
120
?
Yes
No
121
Heat Pump Filed; Input Power Charges
122
Gas Furnace?
124
?
Yes
No
125
Gas Furnace Filed; Input Gas Charges
126
Electric Heater?
128
?
Yes
No
129
Electric Heater Filed
130
Input Number of Zones
132
All Dampers Opened
134
Fan Operated at 40 HZ. 40 HZ O.K.?
136
Detect and Display Main Duct Pressure. Check Air Flow and Air Noise
138
Button Operation
140
Proper?
No
Yes
141
Change Amount of Air Flow
142
Maximum Static Pressure Filed (EEPROM)

AIR CONDITIONING SYSTEM

BACKGROUND OF THE INVENTION

1. Field of the Invention

This invention relates to a duct-type air conditioning system with a variable capacity fan, and especially relates to the control of fan speed and/or air pressure of said system. The invention also relates to a unique method and apparatus for inputting information to the air conditioning control system.

2. Description of the Prior Art

In traditional central air conditioning systems which distribute temperature controlled air to each room through air ducts, the required capacity of the fan differs according to each particular installation. The relationship between the total amount of air flow and static pressure in the duct in a single zone system is shown in FIG. 11. The air path resistance varies according to the length and cross-sectional area of the ducts, the shape of the duct branches, the size and shape of diffusers, etc., which vary in each installation.

In the past, a plurality of switching taps are attached to the fan motor which is installed in the heat source unit such as a gas furnace, heat pump, air conditioner, etc. The air conditioning installer determines the optimum setting of the fan speed by measuring the amount of air blown out of the diffuser and the noise level at the diffuser outlet at trial settings; then, the wiring is connected to the tap corresponding to such optimum speed setting.

There are cases wherein the optimum amount of air flow may differ between cooling and heating when the same fan unit is used for both cooling and heating. To respond to such cases, some systems automatically switch taps between cooling and heating by means of the control circuit in the air conditioning system.

The above examples relate to air conditioning systems which air condition an entire house as a single zone ("the single zone system"). On the other hand, there are systems called "multizone systems" which divide a house into a plurality of zones and control the temperature by zone. U.S. Pat. Nos. 4,406,397 and 4,530,395 are examples of multi-zone control systems.

In traditional multi-zone systems, the static pressure in the ducts is controlled at a constant level so that open dampers of one room will not have an effect on the other rooms. Unless the static pressure is so controlled, the air flow into air conditioned rooms having open dampers will increase when the number of open dampers decreases so that unpleasant conditions will occur such as the increase in the velocity of air flow and increase in noise.

Traditionally, the speed of the motor is varied according to the number of open dampers by either switching the taps of the motor by a phase controller or by controlling the power-source frequency and voltage by means of an inverter. Also, as a means to directly control the static pressure in the duct, a pressure sensor is used to control the speed of the motor so that the static pressure will be controlled at a constant level. A further simple method is to install a duct which bypasses the fan, and control the opening of a bypass damper which is installed in the bypass duct so that the static pressure will be controlled.

A control method similar to single zone systems wherein the fan capacity is automatically switched between cooling and heating is available to multi-zone systems. Further, control methods have been proposed wherein the static pressure in the duct is varied according to the thermal load in a room so that a large amount of air will be supplied to rooms having a large thermal load, and a small amount of air will be supplied to rooms having a small thermal load.

At what level the fan speed or the static duct pressure should be set is an important matter common to both single zone systems, and multi-zone systems. If the fan speed is too low, the amount of air flow is low and the efficiency of the heat source unit is not optimized. Thus, it takes a long time to reach the desired room temperature. If the fan speed is too high, the air flow from the diffuser becomes too strong creating drafts. Thus, the comfort level of the room is adversely affected as well as there being an increase in noise due to the increased rate of air flow.

A problem incurred where the fan speed is controlled only in steps by switching taps on the motor is that the optimum air flow cannot be obtained for the house. Even if the fan speed can be controlled on a continuous basis, it is a problem to easily set the optimum fan speed and resulting air flow volume.

Traditional heating systems, whether single or multi-zone, generally utilized a single heat source. Heat pump installations at times were supplemented by electric resistance heaters. If the user required more heat, he would turn on the supplemental electric heaters. Such systems did not provide for automatic selection of the heat source based upon energy costs for various energy sources or based upon ambient temperature. Thus, there was no means to optimize the heating operation if several heat sources were available in the installation.

OBJECTS OF THE INVENTION

An object of the subject invention is to provide an air conditioning system wherein the optimum speed and resulting air volume of the fan can be easily input, and the fan can be variably controlled based upon the speed and volume which has been so input.

Another object is to provide a central thermostat device that is used to input the air conditioning system parameters to a central controller. The central thermostat is designed to interact with the system installer by requesting information in natural language sentence format which is displayed on the central thermostat. It is a related object to store such inputted data in a non-volatile memory so that the information will be saved even in the event of a loss of power.

Yet another object is to provide an air conditioning system with several heat sources, the particular heat source activated depending upon the initial parameters inputted into the central thermostat so that the most economical heat source is automatically selected.

SUMMARY OF THE INVENTION

The present invention provides for a unique method of determining and setting the optimum fan capacity in a single zone or multi-zone air conditioning installation. A variable speed fan is connected to the heating/air conditioning source. Air distribution ducts are connected to the heating/air conditioning source to distribute the conditioned air throughout the system. The inventive device includes a control system having a main thermostat which is connected to the heating/air conditioning source, fans, and which is equipped with an operator actuated switch means which, at initialization of the system, helps the installer set the optimum capacity of the fan by varying the speed of the fan and comparing the air flow noise and air volume until an optimum setting is found. This optimum setting is then input through the thermostat and stored in a non-volatile memory in the control system as the maximum value.

The main thermostat is engineered to interact with the installer whereby the installer communicates with the control system through the thermostat in native language sentences.

Furthermore, the present invention enables the control system to select the heat source in systems having more than one heat source available. The selection is automatically done by the control system based upon information inputted through the main thermostat by the installer. Such information includes the energy costs and heat sources available. The control system will then select the most economical heat source based upon the energy costs, efficiencies of the heating units, and ambient temperature.

In a multi-zone system, the air conditioning system further provides a pressure sensor placed in the output air duct for sensing the air pressure in the main air duct. Once the optimum initial setting is achieved, the pressure sensor signal corresponding to such pressure is stored in the memory of the controller. In a multi-zone system, with the dampers to one or more zones being individually controlled, the capacity of the fan will be variably controlled depending upon the operating pressure in the main air duct so that the operating pressure is kept at the pre-set value that was initially input into the system upon initialization.

BRIEF DESCRIPTION OF THE DRAWINGS

FIG. 3 is a schematic diagram showing the control system of the present invention in a multi-zone system.

FIG. 4 is a circuit diagram of a central controller circuit.

FIG. 7 is a flow chart of the microcomputer program in the central thermostat for initialization of the system.

DESCRIPTION OF THE PREFERRED EMBODIMENTS

Figure 1:
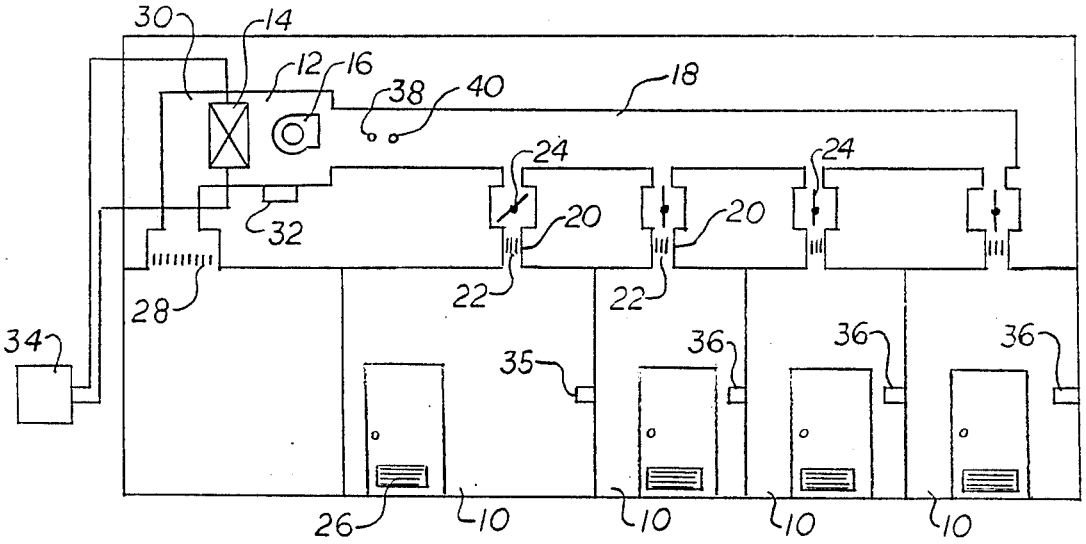
FIG. 1 is a schematic diagram of an overall system structure of a prior art air conditioning system.

Turning first to FIG. 1, there is illustrated a schematic system diagram of an air conditioning system of the prior art. In FIG. 1, each of the rooms 10 are to be air conditioned. In the Figure, four such rooms are illustrated. An indoor unit 12 is an in-house unit installed in the ceiling above the rooms 10. It is composed of a heat exchanger 14 and a blower 16. The heat exchanger may also be provided with an air filter (not illustrated). A main duct 18 is connected to an air supply opening at the in-house unit 12. There are four branch ducts 20 from the main duct 18, each branch duct leading to one of the rooms 10. There is a diffuser 22 placed in the end of each of the branch ducts 20 on the surface of the ceiling of each of the rooms 10. A damper assembly 24 is mounted within each of the branch ducts 20 to provide a throttle type VAV unit. A grill 26 is installed in each of the doors leading to the rooms 10 to allow air to enter the room. A return grill 28 is connected to a return duct 30 which is connected to the in-house unit 12.

There is a central controller 32 located adjacent the unit 12 for operating and controlling a heat source unit 34. A central thermostat 35 is located in one of the rooms 10 to provide an input device for programming the system and to provide a temperature measuring device for that room. A plural number of zone thermostats 36 are provided for each of the other rooms 10. A pressure sensor 38 and a temperature sensor 40 are attached within the main duct 18 and connected to the central controller 32.

The above described system is applicable for use in a multizone system. By eliminating the variable dampers 24 and all of the room thermostats 36, the system would be applicable for a single zone system. Applicant's invention is applicable to either a single zone or multi-zone system, but for illustrative purposes, the more complex multi-zone system is described herein.

Figure 2:
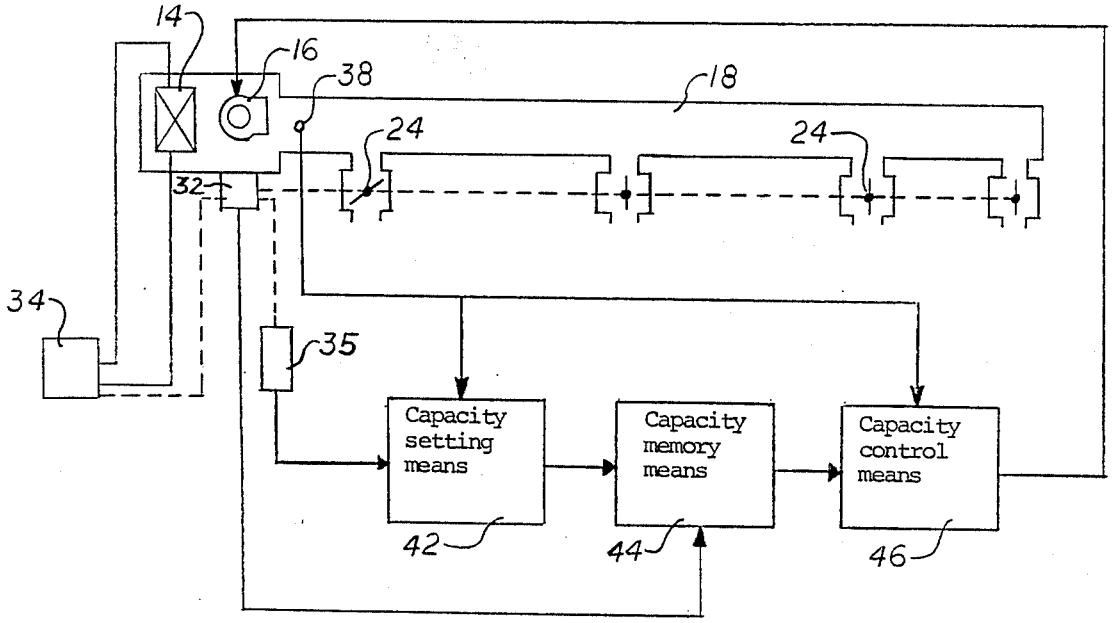
FIG. 2 is a schematic and block diagram showing the overall system structure of the present invention.

FIG. 2 is a schematic and block diagram of the entire system illustrated in FIG. 1. A fan capacity setting means 42 is installed on the central thermostat 35. A fan capacity memory means 44 is installed in the control system 32 and memorizes the output signals of the pressure sensor 38 which correspond to the fan capacity already input and set by the fan capacity setting means 42 as a constant. A fan capacity control means 46 consists of inverters which variably control the speed of the blower 16 (and therefore its capacity) so that the pressure in the main duct 18 will equal the set value based upon the value which has been saved by the fan capacity memory means 44.

FIG. 3 shows the overall relationship of the central thermostat 35 and the central controller 32. It also shows the relationship between the central controller 32 and the heat sources. In FIG. 3 it can be seen that the central thermostat 35 has a communication modem 46 which receives digital signals and serially transmits the signals to a modem 48 in the central controller 32 over a two-wire bus 49. The central thermostat 35 has a random access memory (RAM) 50 to store data which is initially input to it. The central thermostat 35 also has a microcomputer 52 which will be more fully explained later.

The central controller 32 has a microcomputer 54 that communicates with the central thermostat 35 through the modem 48. A buffer 56 interfaces between the microcomputer 54 and a relay panel 58 which controls damper motors 60 which in turn control the dampers 24. Another buffer 62 interfaces between the microcomputer 54 and the heat sources and pressure sensor 38 and air temperature sensor 40. It also interfaces with the blower 16 and a heat pump consisting of an indoor unit 66 and an outdoor unit 68. The outdoor unit 68 also communicates with the microcomputer 54 through a modem 70 in the central controller 32. An outdoor temperature sensor 72 is connected to the outdoor unit 68 of the heat pump. Input data used to initialize the system is stored in an electrically erasable programmable read only memory 74 (EEPROM) which is a non-volatile memory. Thus, in the event of a power failure, the initialized input data will be saved. This minimizes the possibility of having to initialize the system each time in the event of a power failure.

The central controller circuits are illustrated in FIG. 4. Communication modem 46 receives the initial digital signals from the central thermostat 35 via the serial signal input/output terminals 76. The information is saved in the EEPROM 74. The microcomputer 54 has a read only memory (ROM) 78 as part of the central controller 32. The microcomputer 54 is also connected to the blower 16. The speed and capacity of the blower 16 is controlled by a controller having an inverter circuit 80. The maximum capacity of the blower 16 is controlled so as not to exceed the initialized maximum capacity which has been predetermined as will be explained later. The particular heat source that will be utilized (if there is more than one heat source available) will be chosen by the microcomputer 54 and controlled via buffer 62. A random access memory (RAM) 82 is also located in the central controller 32 and is part of the microcomputer 54.

The indoor unit 66 and outdoor unit 68 of the heat pump communicate with the microcomputer 54 via the communication modem 70. Microcomputer 54 also is connected to receive signals from the pressure sensor 38 by means of a pressure sensor signal converter circuit 84. The diaphragm displacement of the static pressure sensor 38 is converted into an electric frequency by means of the circuit 84. The microcomputer 54 receives varying signals from the change in frequency which correspond to pressure changes. The main duct air temperature sensor 40 is connected to the microcomputer 54 by an analog to digital converter 86.

Figure 5:
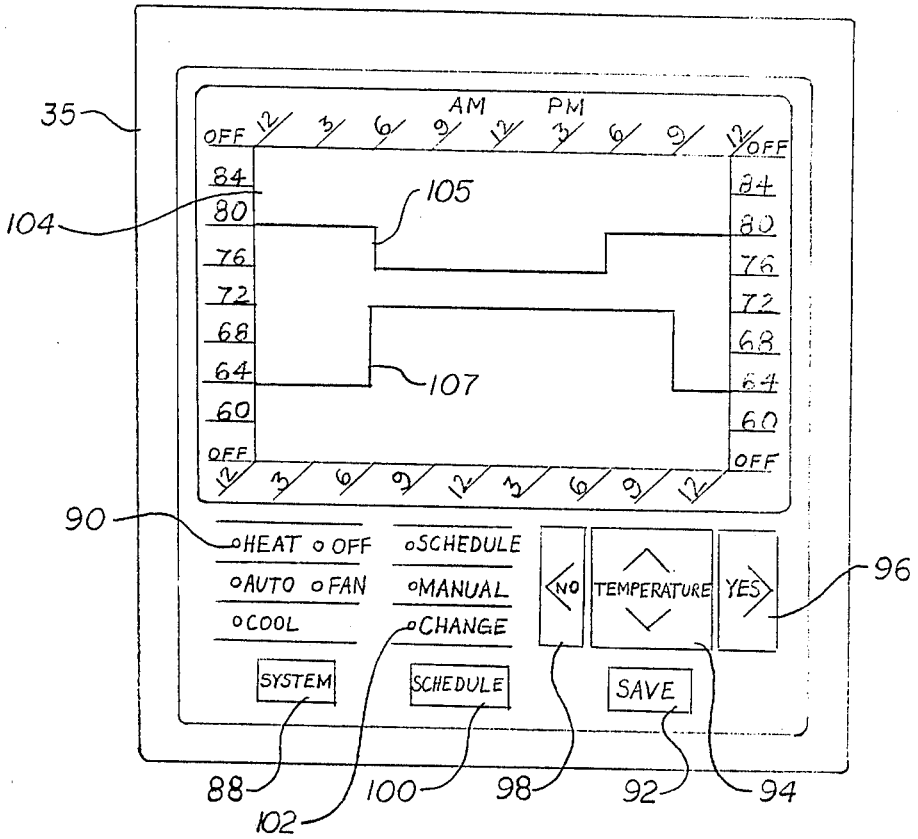
FIG. 5 is a front view of a central thermostat with a liquid crystal display used in the present invention.

FIG. 5 shows the appearance of the central thermostat 35. The operational modes are selected by means of a system key 88. A series of lighted electrical diodes (LED's) 90 are used to display the several modes being HEAT, AUTOMATIC, COOL, OFF, and FAN, all of which correspond to operations of the system key 88. There are a plurality of function keys 92 through 96 for inputing information. A "SAVE" key 92 is used to enter the information. A "TEMPERATURE" key 94 is used to raise or lower the inputed temperature. A "YES" key 96 and "NO" key 98 are used for input and dialog and are also used to control the time input to the thermostat 35. A schedule key 100 is used to select the scheduled air conditioning, manual air conditioning, and change schedule modes which are indicated by lighted electrical diodes (LED's) 102. A graphic display 104 graphically illustrates the schedule on a liquid crystal display (LCD).

By using the keys 94–98, temperature lines 105, 107 can be created. The temperature line 105 shows the air conditioning settings for various times throughout a 24 hour cycle. It can be seen that at 12:00 o'clock midnight, the temperature is set for 80°. At 6:00 a.m. the temperature is set to be reduced to 76°. This temperature is to remain constant until 6:00 p.m. when it is allowed to raise to 80° once more. The heating line 107 can be similarly followed. Once the lines 105 and 107 are established using keys 94–98, the SAVE key 92 enters the data.

Figure 6:
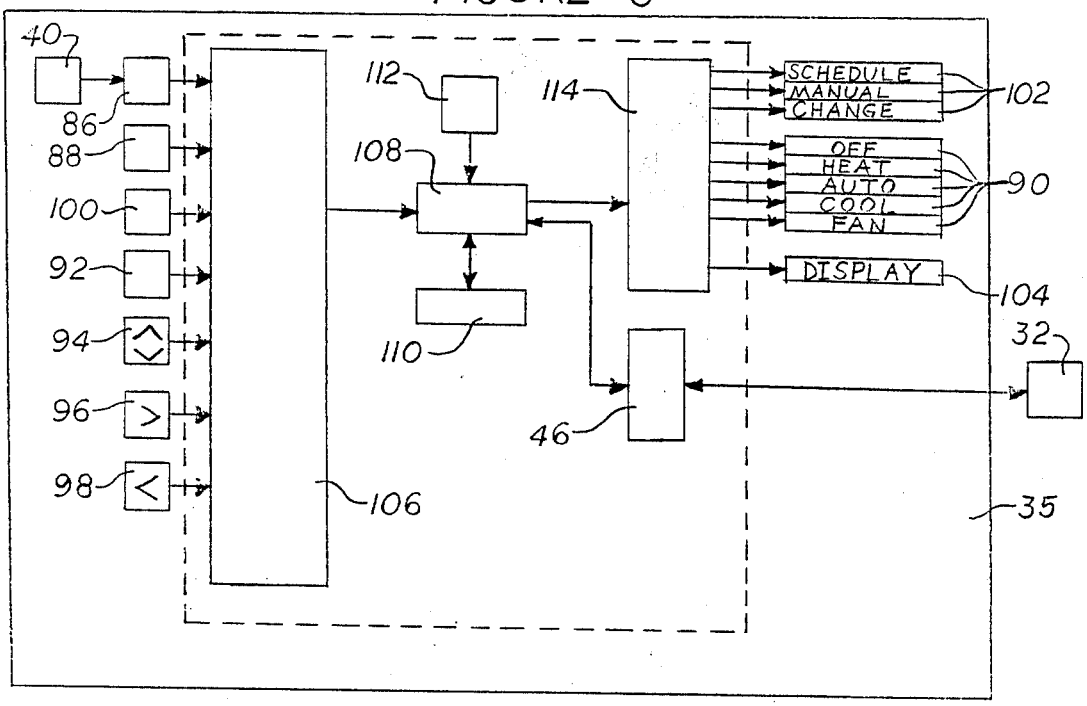
FIG. 6 is a circuit diagram of the internal circuits of the central thermostat shown in FIG. 5.

FIG. 6 illustrates the internal circuits of the central thermostat 35. The microcomputer 52 is equipped with an input unit 106 which receives input signals from the temperature detector 40, a system key 88, and other input keys 92 through 100. The input is transmitted to a central processing unit 108 which has a memory 110 in which control programs and calculation results from the central processing unit 108 and other data are saved. A clock 112 is also connected to the central processing unit 108. Output unit 114 and communication modem 46 are connected to the central processing unit 108. The output unit 114 is connected with the mode-displaying LED's, 90 and 102, as well as with the LCD 104, via a driver circuit which is not illustrated in the Figure. The communication modem 46 is connected to the central controller 32.

FIG. 7 shows the software flow chart of the microcomputer 52 in the central thermostat 35. During initialization the installer interfaces with the system by means of the central thermostat 35 and particularly the liquid crystal display 104. The program permits the installer to communicate with the system in natural language sentence format. The information input by the installer at initialization is stored in the read-only memory which is part of the memory 110 in the microcomputer 52.

It is possible to enter the initialization mode by pressing a combination of keys in accordance with the specific procedure. Usually, the system is initialized by the installer. At step 116, "initial configuration?" will be displayed on the LCD 104. If the installer answers yes by pressing key 96, the next questions displayed on LCD 104 are the various heat sources that may be available. For instance, at step 118, the installer is asked if there is a heat pump. At step 120, if the installer responds with a positive reply, the response is stored at step 121 and further questions are asked such as electrical power charges. At step 122, the installer is asked if there is a gas furnace. If there is a positive response at step 124, it is filed at step 125 and gas charges are input. At step 126, the installer is asked if there is an electric heater, and his response is made at step 128. If there is a yes response, power input charges are entered at step 129.

In an alternate embodiment, steps 120 through 129 are replaced with questions relating to the heat sources and a crossover temperature where one heat source will be more economical than the other. In this embodiment the electric and gas charges are not input.

At step 130, the number of zones are input. All dampers are then opened in step 132 if it is a multi-zone system. If it is a single zone system, there are no dampers to be opened or closed, and in effect, all dampers are opened. In step 134, the blower 16 is initially operated at a certain pre-determined frequency (for example, at 40 Hz which is the mean of a frequency control range of 20 to 60 Hz). The command is conveyed to the central controller 32 via the communication modem 46 in the central thermostat 35, thereby operating the blower 16 via the inverter circuit 80. Concurrently, in step 134, the characters "40 Hz OK?" are displayed on the LCD 104 of the central thermostate 35. This character information has been saved in memory 110 in advance. In place of the display "40 Hz," "67%" can be used by replacing "0 to 60 Hz" with "0 to 100%."

In step 136, the installer physically checks the diffusers 22 for the amount of air volume and listens for air noise. He may use test equipment that measures the volume of air coming through the damper. The main duct static pressure is detected and may also be displayed. The decision to save or change the blower capacity is input into the central thermostat 35 by using the save key 92 and temperature raise or lower key 94 at step 138. If the current operating frequency is proper, the save key 92 is pressed to proceed to step 142 via step 140. In step 142, the data "frequency equals 40 Hz" is transferred from the central thermostat 35 to the EEPROM 74 in the central controller 32. Thus, the initialization mode is automatically completed.

If, in step 136, the amount of air flow or noise is judged to be improper, the key 94 is pressed in step 138, to increase or decrease the value of the operating frequency. The result is fed back to step 134 via step 141, "Change of Frequency," and the display in step 134 changes to "42 Hz OK?," for example. The installer agains checks the diffusers for the amount of air volume and noise. This procedure is repeated until the optimum conditions are found; then, the procedure finally proceeds to step 142.

At step 116, if the installer responds with a "no", the system will operate in its regular routine which includes room temperature detection.

Figure 8:
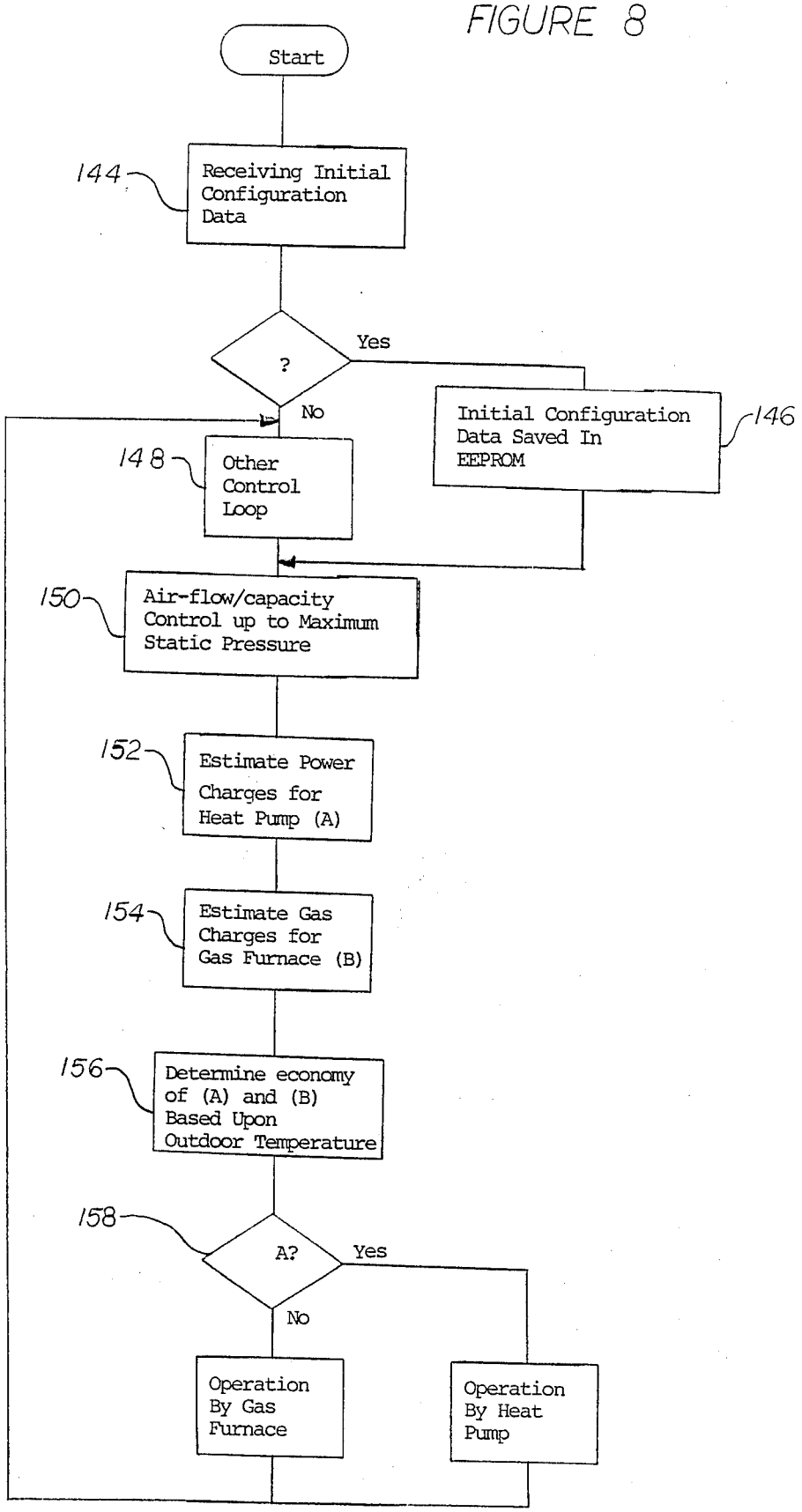
FIG. 8 is a flow chart of the read only memory in the control system for receiving initial input data.

FIG. 8 shows the program flow chart for the ROM 78 in the microcomputer 54 in the central controller 32. Based upon the initial data which is saved in the EEPROM 74, and the signal corresponding to the outdoor temperature which is sent by the outdoor temperature sensor 72, the central controller 32 will select the most efficient heat source unit for operation. Based upon the model and capacity of the selected heat source unit, the variable capacity of the inverter of the outdoor units is interlocked with the indoor/outdoor load to send operating commands to the appropriate units.

The flow chart for read-only memory 78 starts at step 143. At step 144 the initial configuration data from step 142 (FIG. 7) is received. If the data is being received, the initial configuration data is saved in the EEPROM 74 at step 146. If initial configuration data is not being received, we proceed to step 148 which is an alternate control loop. At step 150 the fan capacity is controlled up to a maximum capacity to reach the maximum static pressure. The power charges for heat pump operation are calculated at step 152, and the gas charges for gas furnace operation are calculated at step 154. A comparison is made at step 156 to determine the economy of either selecting the heat pump or gas furnace for activation based upon the outdoor temperature. At step 158, the selection is made to choose either the heat pump or gas furnace.

Figure 9:
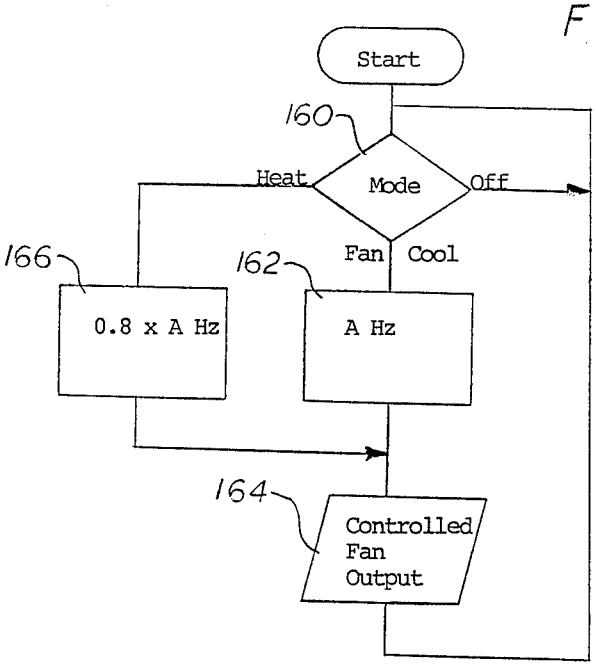
FIG. 9 is a flow chart for blower control during normal operation of the system.

FIG. 9 illustrates the control flow chart used for the control of the blower 16 in its usual operation. In step 160, the operation mode is determined. If the mode is OFF, the system returns to the initial stage. If the mode is the cooling mode or the air-flow mode, the system proceeds to step 162. In step 162 the frequency value which has been saved in the EEPROM 74 of the central controller 32 is recalled and the blower 16 is operated by the fan control device and inverter circuit 80 at the saved frequency value (step 164). If the mode is judged to be the heating mode in step 160, the system proceeds to step 166 and the blower 16 is operated at 80% of the frequency value which has been saved in the EEPROM 74. The 80% factor is not necessarily a fixed percentage but is only one fixed variable which has been utilized by applicants. It may be determined upon further developments that a slightly greater or lesser frequency value rather than 80% of the saved frequency value should be used in the heating mode.

Figure 10:
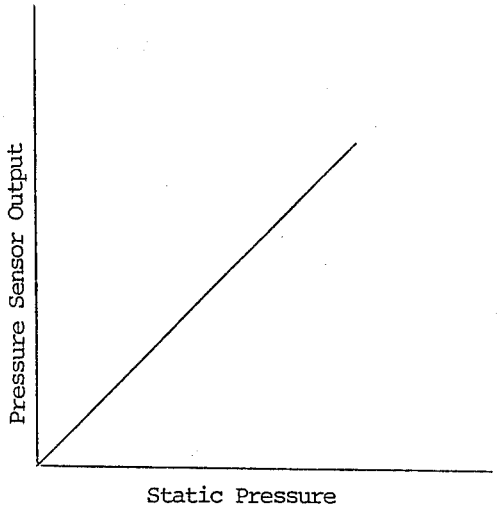
FIG. 10 is a graph showing the relationship between the static pressure in the duct and the output signals of the pressure sensor.

In step 140 of the initialization mode, as illustrated in FIG. 7, a maximum operating frequency is established. At step 142 the maximum static pressure is stored in the EEPROM 74 of the central controller 32. This value will be the value of the output signals of the pressure sensor 38 at the optimum operating capacity of the blower 16 corresponding to the optimum frequency of the inverter circuit 80. For example, if the optimum frequency is 50 Hz, the static duct pressure corresponding to this frequency will be established. The output of the pressure sensor 38 will be a value corresponding to this pressure which will be saved in the EEPROM 74. The characteristic graph showing the relationship between the static pressure in the duct and the output signals of the pressure sensor 38 is illustrated in FIG. 10. As the static pressure increases, the pressure sensor output increases proportionally.

Figure 11:
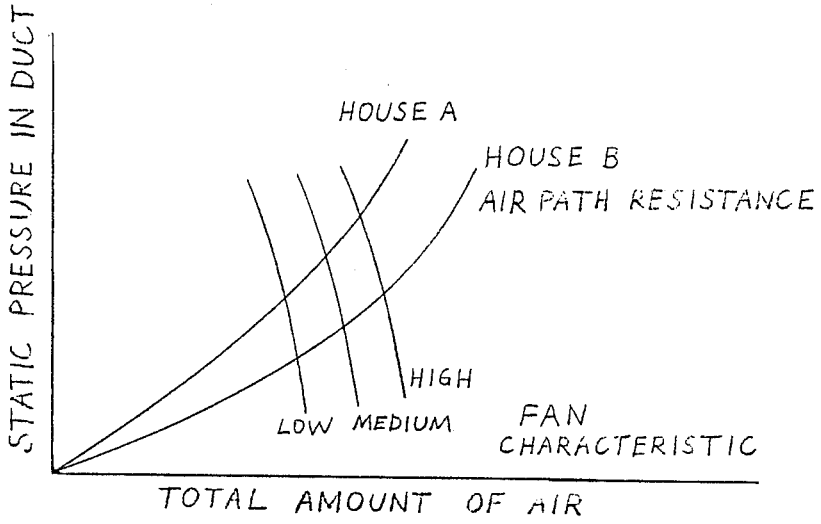
FIGS. 11 and 12 are graphs showing the relationship between the total amount of air flow and static pressure in single and multi-zone systems.
Figure 12:
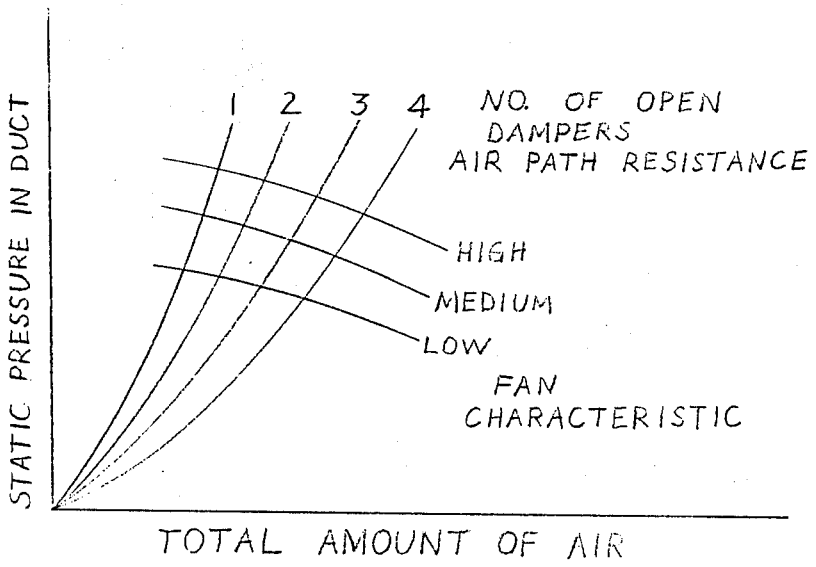

The control of the blower 16 in usual operation can be explained by viewing FIGS. 11 and 12. FIG. 11 applies to a single zone system and FIG. 12 applies to a multi-zone system. The air path resistance greatly varies according to duct characteristics and the number of open dampers 24. However, if the speed of the blower 16 is controlled so that the static pressure in the duct will be at a constant level, a relatively constant volume of air flow can be sent out of each damper 24, regardless of the number of open dampers 24. Thus, there will be no undesirable increase in the velocity of air flow and/or air noise in the room. Also, the room temperature can be controlled on a consistant basis.

The pressure sensor 38 may show a slight change in its output characteristics due to the passage of time or a change in the ambient temperature. This problem can be solved by a correction factor so that the output of the pressure sensor 38 when the blower 16 is not operating, will be always automatically corrected to 0%.

In the above working examples, the system was explained with a view towards a multi-zone system. However, by the elimination of the dampers 24 and room thermostats 36, the system would be applicable to a single zone system. In any event, either system is so designed such that the capacity of the blower 16 will be varied according to cooling, heating, and air circulating to vary the amount of air flow. However, the system can employ a constant air-flow operating system by taking into account the characteristics of the heat source unit 34, etc. Also, arrangements can be made so that, based upon the thermal load of each room which is detected by the central thermostat 35 or room thermostats 36, when the thermal load is large (i.e., the difference between the set room temperature and the actual room temperature is large), the system will be operated with increased air flow by increasing the speed of the blower 16. When the thermal load is small, the system will be operated with a lower capacity, and a small amount of air flow will result. Also, the maximum speed of the blower 16 or the maximum static pressure in the duct 18 at this time will equal the value saved in the EEPROM 74 of the central controller 32.

In the above examples, a heat pump is used for the heat source 34. However, a gas furnace, a combination of gas furnaces and heat pumps, a combination of heat pumps and electric heaters, air conditioners, or varying combinations of these units can be used for the heat source unit. Also, in the above examples, an inverter circuit 80 was used as the blower controller device for controlling the speed of the blower motor. However, some other capacity control means, such as a power source phase control system, can be used.

Also, in the above examples, the EEPROM 74 in which the maximum value of the fan capacity is saved is located i the microcomputer 54 in the central controller 32. However, the EEPROM 74 can be installed remote from the central controller 32 such as, for example, in the microcomputer 52 in the central thermostat 35.

Thus, there has been provided in this invention, a blower capacity setting means in which the maximum value is set by means of the central thermostat and saved in a memory device. The maximum blower capacity can be easily set according to the system so that the blower capacity will be variably controlled by the blower capacity control means based upon the value saved in the memory. Thus, the blower can be operated at optimum conditions thereby supplying the optimum air flow.

Also, in the subject invention wherein dampers and pressure sensors are used in a multi-zone system, a stable and constant amount of air flow can be obtained through the diffusers regardless of the number of rooms to be air conditioned. This is the result of the capacity memory means retaining the value corresponding to the output signals of the pressure sensor in the optimum operating condition of the blower. Also, the optimum blower capacity can be easily input without special keys by installing a natural language dialog input means on the central thermostat. In applicant's invention a liquid crystal display is used.

Furthermore, the saved data will not be lost in the event of a temporary power failure or other such occurrence as the data is inputed into the EEPROM. By utilizing the stored initialization information for the maximum blower capacity, the blower capacity will be varied according to operating conditions by using the value saved as the upper limit value of the blower operating capacity. This will eliminate excessive velocity of air flow and excessive air noise in the operating system.

Thus it is apparent that there has been provided, in accordance with the invention, an air conditioning system that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An air conditioning system comprising:

a warm or cool air generating heat source unit, a capacity variable blower connected to the heat source unit, ducts in fluid communication with the blower to distribute warm or cool air, means for measuring air flow volume outputted by the air, generating heat source unit, means for measuring air flow noise of the air as it exits the ducts, a central thermostat having a plurality of operator controlled operational switches, and a control system which is operatively connected to the heat source unit, blower and central thermostat, the control system comprising:

a blower capacity setting means having an alphanumeric display which, at initialization of the system, establishes an optimum capacity value by the operator actively interacting with the system by a question and answer dialog in native language format and entering signals through the operational switches on the central thermostat corresponding to a desired input to vary the capacity of the blower, the operator measuring the air flow volume and air flow noise until the optimum capacity value is reached and inputting said optimum capacity value through the operational switches on the thermostat;

a capacity memory means for storing the optimum capacity value which has been input by the capacity setting means as maximum value; and a capacity control means which variably controls the operating capacity of the fan so as not to exceed the optimum value saved by the capacity memory means.

2. The air conditioning system of claim 1 wherein the capacity setting means further comprises a liquid crystal display which displays characters on the thermostat.

3. The air conditioning system of claim 2 wherein the liquid crystal display and operational buttons can also be used to input and output data necessary for the initialization of the control system and operation control.

4. The air conditioning system of claim 1 wherein the capacity memory means comprises an electrically erasable programmable read only memory semiconductor device that retains its memory even in the event of a power failure.

5. The air conditioning system of claim wherein the capacity control means comprises an inverter.

6. The air conditioning system of claim 1 wherein the blower capacity value which is inputted by the capacity setting means will be the maximum value for the system based upon the maximum permissible amount of air flow and noise.

7. The air conditioning system of claim 1 wherein the capacity control means will maintain a constant air pressure in the ducts by controlling the blower capacity.

8. The air conditioning system described in claim 1 wherein the capacity control means will vary the operating capacity value of the fan up to the value which has been saved in the capacity memory means as the maximum value depending upon whether the system is in a cooling, heating or air circulation mode.

9. The air conditioning system of claim 1 wherein the capacity control means will vary the operating capacity value of the fan responsive to the temperature over a predetermined time interval which will be detected by the thermostat with the value which has been saved in the capacity memory means as the maximum value.

10. The air conditioning system of claim 6 wherein the capacity control means will vary the operating capacity value of the fan responsive to the temperature over a predetermined time interval which will be detected by the thermostat with the value which has been saved in the capacity memory means as the maximum value.

11. The air conditioning system of claim 1 wherein the warm air generating heat source unit comprises at least two available heat source units, one being a gas heat source unit and the other being an electric heat source unit, with information relating to operational costs of gas and electricity being entered into the control system during initialization.

12. The air conditioning system of claim 11 wherein the control system will automatically select the most economical heat source unit for operation depending upon ambient air temperature and the information relating to operational costs entered into the system.

13. An air conditioning system comprising:

a warm or cool air generating heat source unit, a capacity variable blower connected to the heat source unit, ducts in fluid communication with the blower to distribute warm or cool air, dampers which are installed in the ducts for adjusting the air flow, a pressure sensor for detecting air flow pressure in the ducts, means for measuring air flow volume outputted by the air generating heat source unit, means for measuring air flow noise of the air as it exists the ducts, a central thermostat having a plurality of operator controllble operational switches, and a control system which is operatively connected to the heat source unit, fan, dampers, pressure sensor and thermostat, the control system comprising:

a blower capacity setting means having an alphanumeric display which, at initialization of the system, establishes an optimum capacity value by the operator actively interacting with the system by a question and answer dialog in native language format and entering signals through the operational switches on the central thermostat corresponding to a desired input to vary the capacity of the blower and the air pressure in the duct, the pressure sensor measuring the air pressure, and the operator measuring the air flow volume and air flow noise, until the optimum capacity value is reached, and inputting said optimum capacity value through the operational switches on the thermostat;

a capacity memory means for storing the optimum capacity value which has been input by the capacity setting means as a maximum value; and a capacity control means which variably controls the capacity of the fan so that the air pressure in the duct will not exceed the set value which has been saved in the capacity memory means.

14. The air conditioning system of claim 13 wherein the pressure sensor generates an output signal corresponding to the sensed air pressure, the output signal being saved in the capacity memory means.

15. The air conditioning system of claim 14 wherein the output signal corresponding to the maximum air pressure in the duct which is saved in the capacity memory means will be the maximum value for the system determined by the air flow volume and air flow noise.

16. The air conditioning system of claim 14 wherein the capacity control means will maintain the operating pressure in the duct at a constant level by comparing the sensed pressure to the value which has been saved in the capacity memory means and controlling the blower in response thereto.

17. The air conditioning system of claim 13 wherein the capacity control means will vary the air pressure in the duct depending upon whether a cooling, heating or air circulation mode is selected, with the optimum capacity value which has been saved in the capacity memory means as the maximum value.

18. The air conditioning system of claim 13 wherein the capacity control means will vary the air pressure in the duct responsive to the temperature over a predetermined time interval which will be detected by the thermostat with the value which has been saved in the capacity memory means as the maximum value.

19. The air conditioning system of claim 13 wherein the warm air generating heat source unit comprises at least two available heat source units, one being a gas heat source unit and the other being an electric heat source unit, with information relating to operational costs of gas and electricity being entered into the control system during initialization.

20. The air conditioning system of claim 19 wherein the control system will automatically select the most economical heat source unit for operation depending upon ambient air temperature and the information relating to operational costs entered into the system.

21. An air conditioning system comprising:

a warm or cool air generating unit, a capacity variable blower in fluid communication with the heat source unit, an air duct in fluid communication with the blower to distribute warm or cool air, means for measuring air flow volume outputted by the air generating heat source unit, means for measuring air flow noise of the air as it exits the ducts, a central thermostat having a plurality of operator controllable operational switches, and a control system which is operatively connected to the heat source unit, blower and central thermostat, the control system comprising:

a blower capacity setting means having an alphanumeric display in conjunction with the operational switches for setting the optimum capacity of the blower at initialization of the system by the operator actively interacting with the system by a question and answer dialog in native language format and entering signals through the operational switches on the central thermostat corresponding to a desired input to vary the capacity of the blower, the operator measuring the air flow volume and air flow noise until the optimum capacity is reached;

temporary memory storage means in the central thermostat for storing data representative of the optimum capacity;

non-volatile memory means for storing the data representative of the optimum capacity;

means for transferring the data from the temporary memory storage means to the non-volatile memory means; and a capacity control means for variably controlling the operating capacity of the blower based upon the data representative of the optimum capacity that has been stored in the non-volatile memory means such that the maximum speed and capacity of the blower cannot exceed the optimum capacity set at initialization of the system.

22. The air conditioning system of claim 21 wherein the capacity setting means further comprises a liquid crystal display which displays characters on the thermostat.

23. The air conditioning system of claim 22 wherein the liquid crystal display and operational buttons can also be used to input and output data necessary for the initialization of the control system and operation control.

24. The air conditioning system of claim 21 wherein the warm air generating heat source unit comprises at least two available heat source units, one being a gas heat source unit and the other being an electric heat source unit, with information relating to operational costs of gas and electricity being entered into the control system during initialization.

25. The air conditioning system of claim 24 wherein the control system will automatically select the most economical heat source unit for operation depending upon ambient air temperature and the information relating to operational costs entered into the system.

26. The air conditioning system of claim 21 wherein the non-volatile memory means comprises an electrically erasable programmable read only memory semiconductor device that retains its memory even in the event of a power failure.

27. The air conditioning system of claim 21 wherein the blower capacity value which is inputted by the capacity setting means will be the maximum value for the system based upon the maximum permissible amount of air flow and noise.

28. The air conditioning system of claim 21 wherein the capacity control means will maintain a constant air pressure in the ducts by controlling the blower capacity.

29. The air conditioning system described in claim 21 wherein the capacity control means will vary the operating capacity value of the fan up to the value which has been saved in the capacity memory means as the maximum depending upon whether the system is in a cooling, heating or air circulation mode.

30. The air conditioning system of claim 21 wherein the capacity control means will vary the operating capacity value of the fan responsive to the temperature over a predetermined time interval which will be detected by the thermostat with the value which has been saved in the capacity memory means as the maximum value.

31. The air conditioning system of claim 21 wherein the data stored in the temporary memory storage means is converted to digital signals and serially transmitted to the non-volatile memory means.

32. The air conditioning system of claim 31 wherein the non-volatile memory is remotely located with respect to the central thermostat.

33. The air conditioning system of claim 22 wherein the dialog questions request information relating to the heat sources, number of zones to be air conditioned and energy charges.

* * * * *

UNITED STATES PATENT AND TRADEMARK OFFICE

CERTIFICATE OF CORRECTION

PATENT NO. : 4,795,088

DATED : January 3, 1989

INVENTOR(S) : Toyohiro Kobayashi, Nobuo Otsuka, Peter Thompson, and Larry J. Stratton.

It is certified that error appears in the above-identified patent and that said Letters Patent is hereby corrected as shown below:

Column 10, line 30 - After "claim" insert -- 1 -- ;
Column 11, line 15 - Delete "controllble" and substitute -- controllable --

Signed and Sealed this

Twenty-fifth Day of April, 1989

*Attest:*

*Attesting Officer*

DONALD J. QUIGG

*Commissioner of Patents and Trademarks*